US009490543B2

(12) United States Patent
Yang et al.

(10) Patent No.: US 9,490,543 B2
(45) Date of Patent: Nov. 8, 2016

(54) COMBINATION LTE AND WIGIG ANTENNA

(71) Applicant: Intel Corporation, Santa Clara, CA (US)

(72) Inventors: Songnan Yang, San Jose, CA (US); Helen K. Pan, Portland, OR (US); Manish A. Hiranandanl, Santa Clara, CA (US); Fan (Cherry) Xia, Shanghal (CN); Ulun Karacaoglu, San Diego, CA (US)

(73) Assignee: Intel Corporation, Santa Clara, CA (US)

( * ) Notice: Subject to any disclaimer, the term of this patent is extended or adjusted under 35 U.S.C. 154(b) by 220 days.

(21) Appl. No.: 14/230,316

(22) Filed: Mar. 31, 2014

(65) Prior Publication Data

US 2015/0280318 A1 Oct. 1, 2015

(51) Int. Cl.

| | |
|---|---|
| ***H01Q 9/40*** | (2006.01) |
| ***H01Q 21/00*** | (2006.01) |
| ***H01Q 5/378*** | (2015.01) |
| ***H01Q 5/40*** | (2015.01) |

(52) U.S. Cl.
CPC ..... *H01Q 9/40* (2013.01); *H01Q 5/378* (2015.01); *H01Q 5/40* (2015.01); *H01Q 21/00* (2013.01)

(58) Field of Classification Search
CPC ..... H01Q 9/40; H01Q 5/378
USPC ..... 343/700 MS, 725, 729, 893, 702
See application file for complete search history.

(56) References Cited

U.S. PATENT DOCUMENTS

| | | | | |
|---|---|---|---|---|
| 7,298,339 | B1 * | 11/2007 | Ollikainen | H01Q 1/243 343/700 MS |
| 7,446,712 | B2 * | 11/2008 | Itoh | H01Q 13/206 343/700 MS |
| 7,973,726 | B2 * | 7/2011 | Tseng | H01Q 1/243 343/700 MS |
| 8,242,970 | B2 * | 8/2012 | Fukui | H01Q 1/38 343/700 MS |
| 2007/0164920 | A1 * | 7/2007 | Chen | H01Q 1/2275 343/795 |

* cited by examiner

*Primary Examiner* — Hoanganh Le
(74) *Attorney, Agent, or Firm* — Eschweiler & Associates, LLC

(57) ABSTRACT

A combined antenna device includes a coupled feed antenna including a first grounded coupling element and a millimeter wave phased array antenna having a ground plane structure including a portion of the first grounded coupling element.

16 Claims, 3 Drawing Sheets

COMBINATION LTE AND WIGIG ANTENNA

BACKGROUND

Mobile communication devices such as laptop computers, tablet computers, smart phones and personal digital assistants (PDAs) often employ multiple antennas to provide differing forms of wireless communication. With such mobile devices, space within the device housing is a precious commodity and accommodating the various antennas therein to provide the desired functionality is a significant challenge.

DETAILED DESCRIPTION

Figure 1:
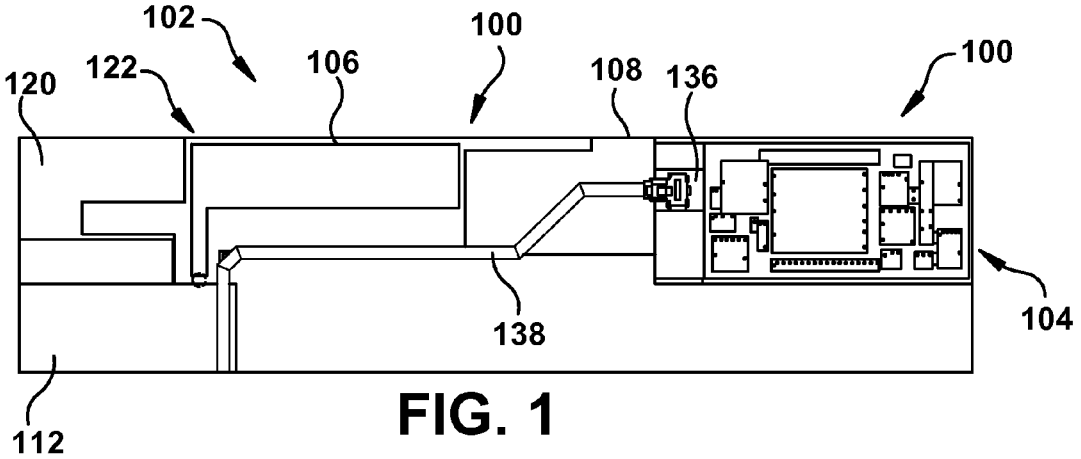
FIG. 1 is a plan view of a combined antenna device comprising a coupled feed antenna and a millimeter wave phased array antenna according to one aspect of the disclosure.

The systems and methods of this disclosure are described with reference to the attached drawing figures, wherein like reference numerals are used to refer to like elements throughout, and wherein the illustrated structures and devices are not necessarily drawn to scale.

A device and method are disclosed that are directed to a combined antenna device and associated method of manufacture.

Turning now to the figures, FIG. 1 is a plan view of a combined antenna device 100 according to one example of the disclosure. The combined antenna device 100 includes a coupled feed antenna 102 and a millimeter wave phased array antenna 104. In one example, the coupled feed antenna

102 comprises a primary radiator element 106 and a first grounded coupling element 108. Further, the millimeter wave phased array antenna 104 has a ground plane structure that comprises a portion of the first grounded coupling element 108 as will be more fully appreciated below.

The combined antenna device 100 of FIG. 1 advantageously reduces a footprint required for what was previously two separate, distinct antennas by combining or integrating together the two antennas into a single, integrated structure. More particularly, the combined antenna device 100 of FIG. 1 integrates two antennas by providing a coupled feed antenna 102 having at least the first grounded coupling element 108 and forming the millimeter wave phased array antenna 104 that has a ground plane structure (e.g., such as an interlayer Pwd/gnd plane, shield, etc.) that comprises a portion of the first grounded coupling element 108 of the coupled feed antenna 102. Therefore the first grounded coupling element 108 forms a part of both antennas, thus integrating the two antennas into a combined antenna device having a reduced footprint as compared to conventional arrangements employing two separate, distinct arrangements.

Figure 2:
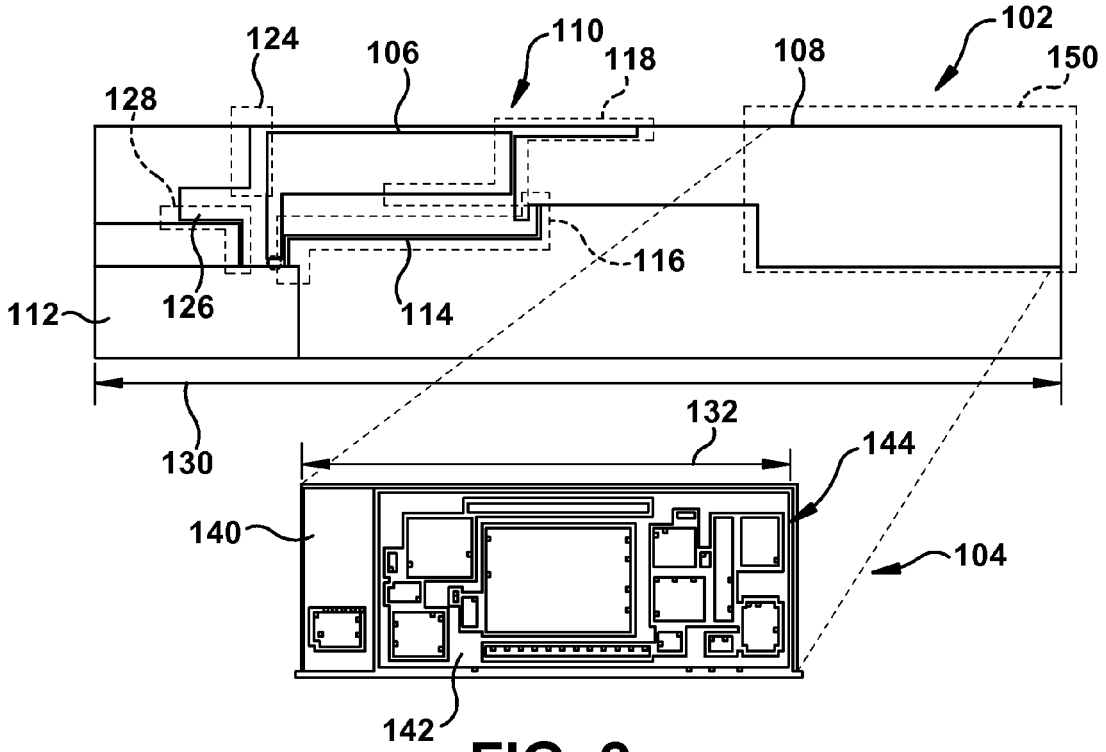
FIG. 2 is a plan view of the two components of the combined antenna device, namely the coupled feed antenna and the millimeter wave phased array antenna, and a manner in which they may be integrated according to one aspect of the disclosure.

In one example the coupled feed antenna 102 of FIG. 1 operates as an LTE antenna that provides for a frequency range of 698 MHz to 2.7 GHz. The primary radiator element 106 does not typically provide the full desired LTE frequency range and thus one or more grounded coupling elements (such as the first grounded coupling element 108 and the second grounded coupling element 120 of FIG. 1) operates to extend the operation of the coupled feed antenna 102 to the full desired frequency range. More particularly, the first grounded coupling element 108 operates to extend a low band bandwidth of the primary radiator element 106 down to 698 MHz, for example, while the second grounded coupling element 120 operates to extend a high band bandwidth of the primary radiator element 106 up to 2.7 GHz The first and second grounded coupling elements 108, 120 operate to extend the frequency range of the primary radiator element 106 by providing a parasitic resonance. For example, as illustrated in FIG. 2, the first grounded coupling element 108 is spatially positioned with respect to a first portion 110 of the primary radiator element 106 at region 118. The spatial arrangement of the two elements 106, 108 forms a first capacitive coupling. Further, a first ground trace 114 couples the first grounded coupling element 108 to the DC ground element 112 to establish a DC ground. The first ground trace 114, however, has a geometry 116 that defines a first inductance that, with the first capacitive coupling, defines a first parasitic resonance that extends the low band bandwidth of the primary radiator element 106. As may be appreciated, by adjusting dimensions of elements 106 and 108 and the first ground trace 114, the extent of the capacitive coupling and the inductance can be tuned, respectively, to achieve the desired amount of low band bandwidth extension. In FIG. 1 and in subsequent figures, the dotted circle between region 106 and region 112 constitutes the feed point of the coupled feed antenna 102 according to one example.

Similarly, the second grounded coupling element 120 is spatially positioned with respect to a second portion 122 (see FIG. 1) of the primary radiator element 106 at region 124 (see FIG. 2). The spatial arrangement of the two elements 106, 120 forms a second capacitive coupling. Further, a second ground trace 126 couples the second grounded coupling element 120 to the DC ground element 112 to establish a DC ground. The second ground trace 126 has a geometry 128 that defines a second inductance that, with the second capacitive coupling, defines a second parasitic resonance that extends the high band bandwidth of the primary radiator element 106. As may be further appreciated, the dimensions of elements 106, 120 and the second ground trace 126 can be adjusted to tune the desired amount of high band bandwidth extension.

FIG. 2 illustrates how the integrating of the millimeter wave phased array antenna 104 as a portion of the first grounded coupling element 108 of the coupled feed antenna 102 serves to reduce the total footprint for the desired antenna functionality. In one non-limiting example, if a length 130 of the coupled feed antenna 102 is about 70 mm, and a length 132 of the millimeter wave phased array antenna 104 is about 25 mm, with a spacing there between of about 5 mm (when disposed laterally with respect to one another), a conventional arrangement with the elements as distinct, separate elements would require a footprint of about 100 mm. In accordance with the present disclosure, however, by integrating the millimeter wave phased array antenna 104 into the coupled feed antenna 102 by making it a portion of the first grounded coupling element 108, the total footprint is about 70 mm, thereby providing for a footprint reduction of about 30%.

Figure 3:
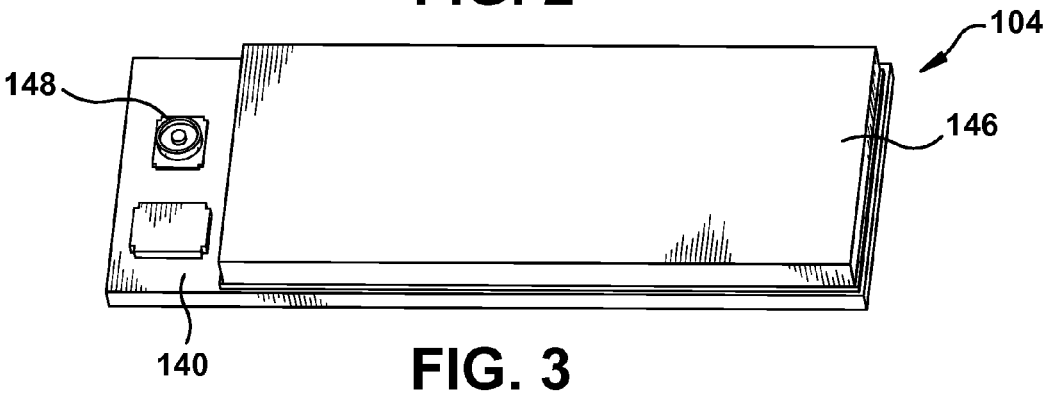
FIG. 3 is a perspective view of a millimeter wave phased array antenna in an RF front end module with integrated circuit package according to one aspect of the disclosure.

Turning now to FIG. 3, a perspective/plan view of the millimeter wave phased array antenna 104 according to one example of the disclosure is provided. The millimeter eave antenna array 104 has a ground plane structure 140 upon which a substrate 142 may reside (see FIG. 2). On the substrate 142 an array of antenna elements 144 are formed, as shown in FIG. 2. A shield structure 146 is formed over the substrate 142 and operates to cover the antenna elements 144, as illustrated in the example of FIG. 3. The ground plane structure 140 includes a port 148 in one example, wherein the port 148 is configured to receive a coaxial cable or other type cable to establish a RF connection between the RFEM and the WiGig module, while in the meantime it also forms a DC ground connection with whatever type of housing the combined antenna device 100 resides within. In one example, the combined antenna device 100 resides within a laptop computer, and the port 148 receives a coaxial cable that couples the ground plane structure 140 to a system ground of the laptop computer via the outer conductor of the coaxial cable.

As shown in FIGS. 2 and 3, the ground plane conductor 140 in one example comprises a portion 150 of the first grounded coupling element 108. In one example, the millimeter wave phased array antenna 104 comprises a WiGig antenna/radio front end module (RFEM) that operates as a short range (e.g., a few meters), 60 GHz (i.e., short wavelength), high data rate (e.g., 6 Gbits/s) antenna. In one example such antenna 104 is a high gain, narrow beamwidth, high directional antenna that provides functionality such as for use in a wireless display (e.g., sending data wirelessly to a television display) or other desired functions. This methodology may be implemented for any RFEM design with integrated antenna and RFIC other than 60 GHz phased array antenna to save space without simultaneous operations in general, and all such variations and permutations are contemplated as falling within the scope of the present disclosure.

Referring back to FIG. 1, in one example a connector 136 couples to the port 148 of FIG. 3 and a coaxial cable 138. The outer conductor of coaxial cable 138 extends along the first ground trace 114 of FIG. 2 and makes electrical contact thereto. In the above fashion, the conductor 138 operates to couple the ground element 112 with the ground plane structure 140 of the millimeter wave phased array antenna 104. In one example, the size, length and shape of the coaxial cable outer conductor 138 is dictated by the needed or desired inductance of the first ground trace 114 to establish the desired low band bandwidth of the coupled feed antenna 102.

Figure 4:
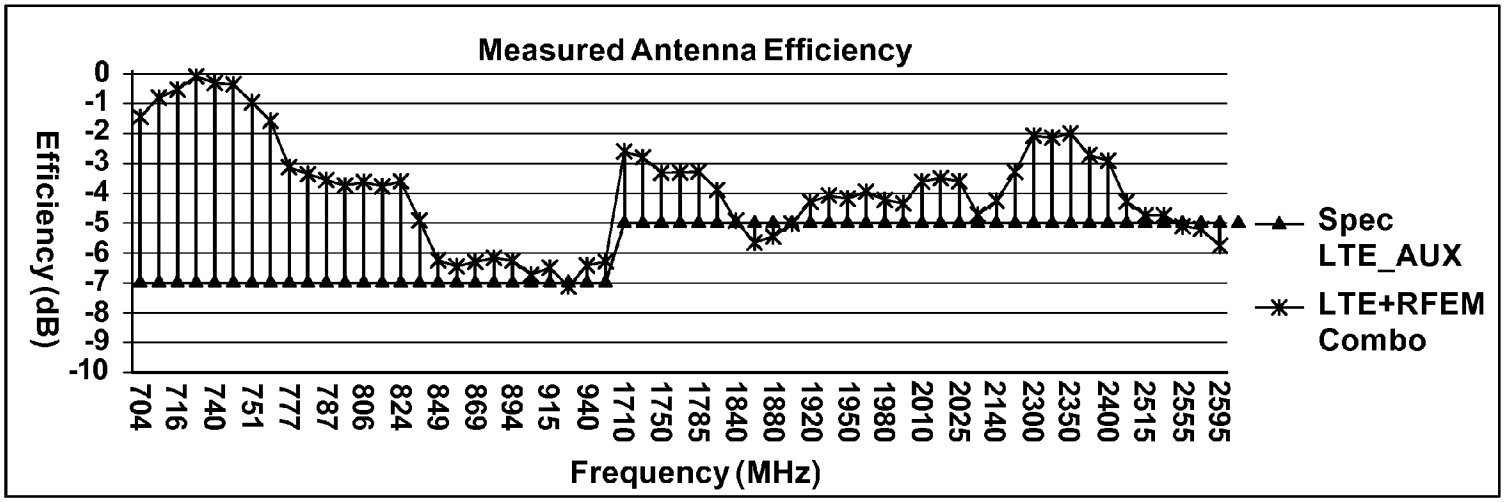
FIG. 4 is a graph illustrating an LTE band antenna efficiency of the combined antenna device against the LTE specification in accordance with one aspect of the disclosure.

The above integrated or combined antenna device 100 of the figures advantageously operates to provide dual antenna functionality with a decreased foot print over conventional configurations. In addition, such size decrease advantages are obtained without adversely affecting the performance of the coupled feed antenna. In one example with the coupled feed antenna operating as an LTE antenna, FIG. 4 illustrates a measured antenna efficiency performance across the LTE frequency range, as compared to the specification requirements for an auxiliary LTE antenna. As can be seen, the coupled feed antenna meets or exceeds the specification across almost all LTE frequency bands.

Figure 5:
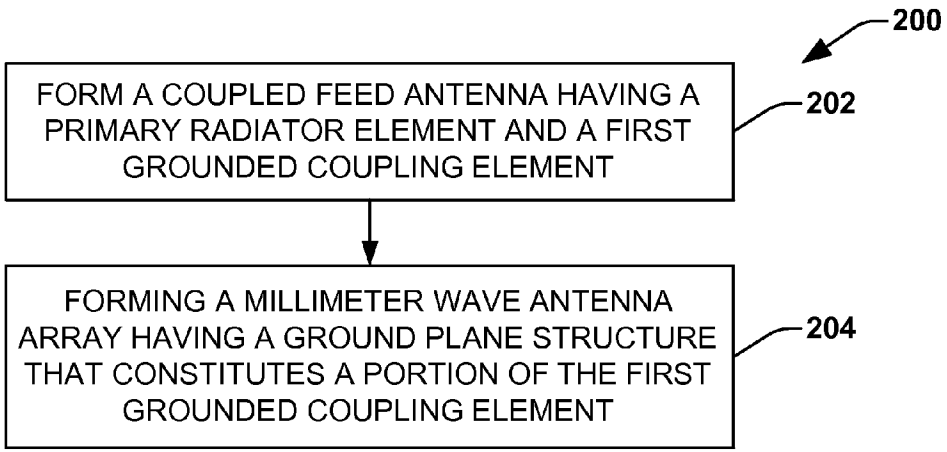
FIG. 5 is a flow diagram illustrating a method of constructing a combined antenna device in accordance with one aspect of the disclosure.

FIG. 5 is a flow chart illustrating a method 200 of constructing a combined antenna device. While the method provided herein is illustrated and described as a series of acts or events, the present disclosure is not limited by the illustrated ordering of such acts or events. For example, some acts may occur in different orders and/or concurrently with other acts or events apart from those illustrated and/or described herein. In addition, not all illustrated acts are required and the waveform shapes are merely illustrative and other waveforms may vary significantly from those illustrated. Further, one or more of the acts depicted herein may be carried out in one or more separate acts or phases.

Figure 6:
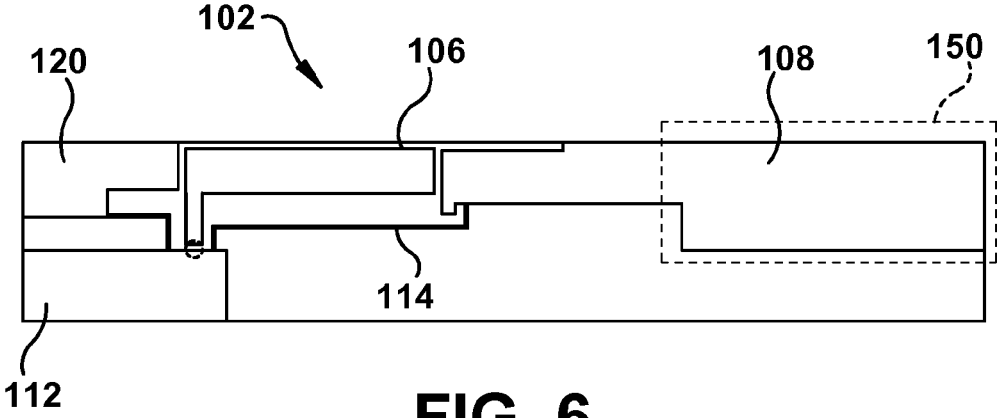
FIG. 6 is a plan view illustrating a portion of the combined antenna device at one stage of formation, comprising a coupled feed antenna in accordance with one aspect of the disclosure.

The method 200 comprises forming a coupled feed antenna having a primary radiator element and at least a first grounded coupling element at 202. One example of a coupled feed antenna is illustrated in FIG. 6 at 102. In this example, the coupled feed antenna 102 has a primary radiator element 106, a first grounded coupling element 108 and a second grounded coupling element 120. The method 200 continues at 204 by forming a millimeter wave phased array antenna having a ground plane structure that comprises a portion of the first grounded coupling element. This can be seen, for example, in FIG. 7, wherein a millimeter wave phased array antenna 104 comprises a portion 150 of the first grounded coupling element 108 in FIG. 6.

In one example, act 202 is performed by initially sizing the portion 150 of the coupled feed antenna 102 to match a dimension of the millimeter wave phased array antenna 104, and then cutting the portion 150 of the coupled feed antenna 102 away and attaching the millimeter wave phased array antenna 104 thereto. Alternatively, the portion 150 of the first grounded coupling element 108 may serve as the ground plane structure 140 for the millimeter wave phased array antenna 104 and a substrate having a plurality of array elements are subsequently formed thereon (along with an optional cover shield) to complete the array 104.

Figure 7:
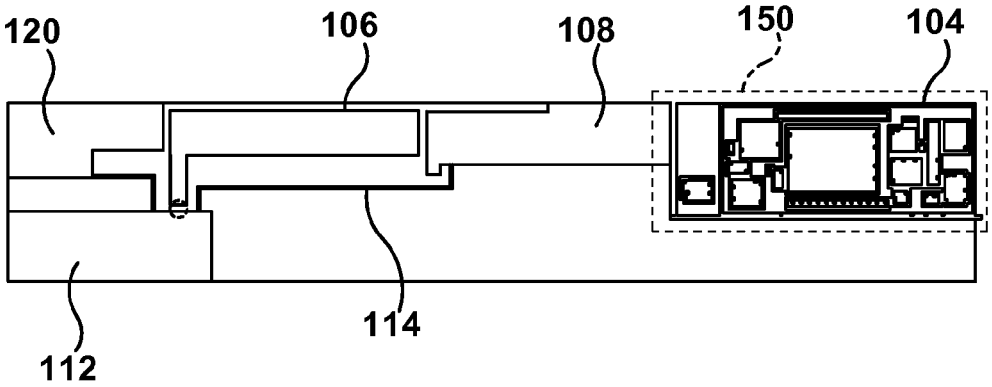
FIG. 7 is plan view illustrating another portion of the combined antenna device at another stage of format, comprising a coupled feed antenna and a millimeter wave phased array antenna having a ground plane structure that comprises a portion of a first grounded coupling element of the coupled feed antenna in accordance with an aspect of the method of constructing the combined antenna device.
Figure 8:
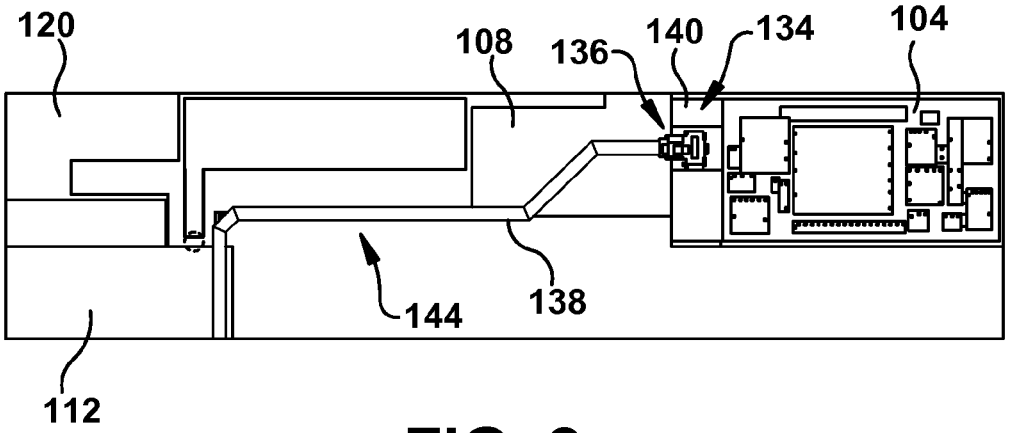
FIG. 8 is plan view showing a completed combined antenna device, and illustrating a connector that connects a ground plane structure to a ground potential by extending along and electrically contacting a portion of a first ground trace between the ground element and the ground plane structure according to still another aspect of the method of constructing the combined antenna device.

Referring back to 202 of FIG. 5, the forming of the coupled feed antenna 102 may further comprise forming a ground element such as element 112 in FIGS. 6-8. Further, a first ground trace 114 is formed that extends between the ground element 112 and the first grounded coupling element 108. Further, referring back to 204 of FIG. 5, the ground plane structure 140 of the millimeter wave phased array antenna 104 includes a port 134 for receiving a connector 136. Outer conductor of coaxial cable 138 couples to the port 134 via the connector 136 and extends along, and electrically contacts, the first ground trace 114 between the ground plane structure 140 and the ground element 112, as illustrated in FIG. 8. A shield 146 may then be placed over the millimeter wave phased array antenna, for example, as illustrated in FIG. 3.

In one example a combined antenna device comprises a coupled feed antenna comprising a first grounded coupling element and a millimeter wave phased array antenna having a ground plane structure. The ground plane structure comprises a portion of the first grounded coupling element.

In one example the coupled feed antenna further comprises a primary radiator element. The first grounded coupling element is spatially positioned with respect to a first portion of the primary radiator element, and is configured to form a first capacitive coupling thereto that creates a first parasitic resonance that extends a low band bandwidth of the primary radiator element.

In one example the coupled feed antenna further comprises a ground element, and a first ground trace. The first ground trace extends between the ground element and the first grounded coupling element, and has a geometry that defines a first inductance that, with the first capacitive coupling, defines the first parasitic resonance thereof.

In one example, the coupled feed antenna of any of the earlier examples further comprises a second grounded coupling element that is spatially positioned with respect to a second portion of the primary radiator. The second grounded coupling element is configured to form a second capacitive coupling with respect to the primary radiator element that creates a second parasitic resonance that extends a high band bandwidth of the primary radiator element.

In one example, the coupled feed antenna further comprises a ground element and a second ground trace. The second ground trace extends between the ground element and the second grounded coupling element. The second ground trace has a geometry that defies a second inductance that, with the second capacitive coupling, defies the second parasitic resonance thereof.

In one example, the millimeter wave phased array antenna of any of the earlier examples comprises the ground plane structure and an array of antenna elements on a substrate that overly the ground plane structure.

In one example the millimeter wave phased array antenna further comprises a shield structure covering the array of antenna elements.

In one example the ground plane structure of the millimeter wave antenna further comprises a port that is configured to receive a connector for RF connection between RFEM and WiGig module, while in the meantime it also couples the ground plane structure to a ground potential.

In one example the millimeter wave phased array antenna of any of the earlier examples comprises the ground plane structure and an array of antenna elements on a substrate overlying the ground plane structure. Further, the millimeter wave phased array antenna further comprises a shield structure covering the array of antenna elements. The ground plane structure of the antenna further comprises a port that is configured to receive a connector for coupling the ground plane structure to a ground potential.

In one example the combined antenna device further comprises a conductor connected to the port of the ground plane structure. The conductor extends along, and electrically contacts, an entirety of the first ground trace between the ground element and the ground plane structure.

In one example a combined antenna device comprises a coupled feed antenna. The coupled feed antenna comprises a primary radiator element, a first grounded coupling element having a ground plane structure forming a portion thereof, and a second grounded coupling element. The combined antenna device further comprises a millimeter wave phased array antenna. The millimeter wave phased array antenna comprises the ground plane structure and a plurality of antenna elements on a substrate overlying the ground plane structure.

In one example, the first grounded coupling element is spatially positioned with respect to a first portion of the primary radiator element and is configured to form a first capacitive coupling therewith.

In one example the combined antenna device further comprises a ground element and a first ground trace. The first ground trace extends between the ground element and the first grounded coupling element. The first ground trace comprises a geometry that defines a first inductance, and the first capacitive coupling and the first inductance define a first parasitic resonance that extends a low band bandwidth of the coupled feed antenna.

In one example the second grounded coupling element is spatially positioned with respect to a second portion of the primary radiator element and is configured to form a second capacitive coupling therewith. Further, the combined antenna device comprises a second ground trace that extends between the ground element and the second grounded coupling element. The second ground trace comprises a geometry that defies a second inductance, and the second capacitive coupling and the second inductance define a second parasitic resonance that extends a high band bandwidth of the coupled feed antenna.

In one example the ground plane structure of the millimeter wave phased array antenna comprises a port that is configured to receive a connector for coupling the ground plane structure to a ground potential. The combined antenna structure further comprises a conductor connected to the port of the ground plane structure that extends along, and electrically contacts, an entirety of the first ground trace between the ground element and the ground plane structure.

In one example, a method of constructing a combined antenna device is disclose and comprises forming a coupled feed antenna having a primary radiator element and at least a first grounded coupling element. The method also comprises forming a millimeter wave phased array antenna having a ground plane structure that constitutes a portion of the first grounded coupling element.

In one example, in the method, forming the coupled feed antenna further comprises forming a ground element and forming a first ground trace extending between the ground element and the first grounded coupling element. In one example the first ground trace comprises a geometry that defies a first inductance, and the first grounded coupling element is spatially positioned with respect to the primary radiator element to define a first capacitive coupling therewith. In one example, the first inductance and the first capacitive coupling define a first parasitic resonance that extends a low band bandwidth of the coupled feed antenna.

In one example of the method the ground plane structure in any of the earlier examples comprises a port that is configured to receive a connector for coupling the ground plane structure to a ground potential. The method further comprises forming a conductor connected to the port that extends along, and electrically contacts, an entirety of the first ground trace between the ground element and the ground plane structure.

In one example, a combined antenna device comprises a coupled feed antenna means comprising a first grounded coupling means and a millimeter wave phased array antenna means having a grounding means comprising a portion of the first grounded coupling means.

In one example, the coupled feed antenna means of the combined antenna device further comprises a primary radiator means and the first grounded coupling means spatially positioned with respect to a first portion of the primary radiator means. The first grounded coupling means is configured to form a first capacitive coupling thereto that creates a first parasitic resonance that extends a low band bandwidth of the primary radiator means.

In one example, the coupled feed antenna means of the combined antenna device further comprises a ground element and a first ground trace extending between the ground element and the first grounded coupling means. The ground trace has a geometry that defines a first inductance that, with the first capacitive coupling, defines the first parasitic resonance thereof.

In one example, the coupled feed antenna means of the combined antenna device of any of the above example further comprises a second grounded coupling means spatially positioned with respect to a second portion of the primary radiator means, and configured to form a second capacitive coupling thereto that creates a second parasitic resonance that extends a high band bandwidth of the primary radiator means.

In one example, the coupled feed antenna means of the combined antenna device further comprises a ground element and a second ground trace extending between the ground element and the second grounded coupling means. The second ground trace has a geometry that defies a second inductance that, with the second capacitive coupling, defies the second parasitic resonance thereof.

It should be understood that although various examples are described separately above for purposes of clarity and brevity, various features of the various examples may be combined and all such combinations and permutations of such examples is expressly contemplated as falling within the scope of the present disclosure.

Although the disclosure has been illustrated and described with respect to one or more implementations, alterations and/or modifications may be made to the illustrated examples without departing from the spirit and scope of the appended claims. Furthermore, in particular regard to the various functions performed by the above described components or structures (assemblies, devices, circuits, systems, etc.), the terms (including a reference to a "means") used to describe such components are intended to correspond, unless otherwise indicated, to any component or structure which performs the specified function of the described component (e.g., that is functionally equivalent), even though not structurally equivalent to the disclosed structure which performs the function in the herein illustrated exemplary implementations of the invention. In addition, while a particular feature of the disclosure may have been disclosed with respect to only one of several implementations, such feature may be combined with one or more other features of the other implementations as may be desired and advantageous for any given or particular application. Furthermore, to the extent that the terms "including", "includes", "having", "has", "with", or variants thereof are used in either the detailed description and the claims, such terms are intended to be inclusive in a manner similar to the term "comprising".

What is claimed is:

1. A combined antenna device, comprising:

a coupled feed antenna comprising a primary radiator element and a first grounded coupling element; and a millimeter wave phased array antenna comprising a ground plane structure comprising a portion of the first grounded coupling element and a plurality of antenna elements on a substrate overlying the ground plane structure.

2. The combined antenna device of claim 1, wherein the first grounded coupling element is spatially positioned with respect to a first portion of the primary radiator element, and configured to form a first capacitive coupling thereto that creates a first parasitic resonance that extends a low band bandwidth of the primary radiator element.

3. The combined antenna device of claim 2, wherein the coupled feed antenna further comprises:

a ground element; and a first ground trace extending between the ground element and the first grounded coupling element, wherein the first ground trace has a geometry that defines a first inductance that, with the first capacitive coupling, defines the first parasitic resonance thereof.

4. The combined antenna device of claim 2, wherein the coupled feed antenna further comprises a second grounded coupling element spatially positioned with respect to a second portion of the primary radiator element, and configured to form a second capacitive coupling thereto that creates a second parasitic resonance that extends a high band bandwidth of the primary radiator element.

5. The combined antenna device of claim 4, wherein the coupled feed antenna further comprises:

a ground element; and a second ground trace extending between the ground element and the second grounded coupling element, wherein the second ground trace has a geometry that defies a second inductance that, with the second capacitive coupling, defies the second parasitic resonance thereof.

6. The combined antenna device of claim 1, wherein the millimeter wave phased array antenna further comprises a shield structure covering the array of antenna elements.

7. The combined antenna device of claim 1, wherein the ground plane structure of the millimeter wave array antenna further comprises a port configured to receive a connector for coupling the ground plane structure to a ground potential.

8. The combined antenna device of claim 1, further comprising a conductor connected to the port of the ground plane structure and extending along, and electrically contacting, an entirety of the first ground trace between the ground element and the ground plane structure.

9. A combined antenna device, comprising:

a coupled feed antenna, comprising:

a primary radiator element;

a first grounded coupling element having a ground plane structure forming a portion thereof; and a second grounded coupling element; and a millimeter wave phased array antenna comprising:

the ground plane structure; and a plurality of antenna elements on a substrate overlying the ground plane structure.

10. The combined antenna device of claim 9, wherein the first grounded coupling element is spatially positioned with respect to a first portion of the primary radiator element and is configured to form a first capacitive coupling therewith.

11. The combined antenna device of claim 10, further comprising:

a ground element; and a first ground trace extending between the ground element and the first grounded coupling element, wherein the first ground trace comprises a geometry that defines a first inductance, wherein the first capacitive coupling and the first inductance define a first parasitic resonance that extends a low band bandwidth of the coupled feed antenna.

12. The combined antenna device of claim 11, wherein the second grounded coupling element is spatially positioned with respect to a second portion of the primary radiator element and is configured to form a second capacitive coupling therewith, further comprising:

a second ground trace extending between the ground element and the second grounded coupling element, wherein the second ground trace comprises a geometry that defies a second inductance, wherein the second capacitive coupling and the second inductance define a second parasitic resonance that extends a high band bandwidth of the coupled feed antenna.

13. The combined antenna device of claim 11, wherein the ground plane structure of the millimeter wave phased array antenna comprises a port configured to receive a connector for coupling the ground plane structure to a ground potential, and further comprising a conductor connected to the port of the ground plane structure and extending along, and electrically contacting, an entirety of the first ground trace between the ground element and the ground plane structure.

14. A method of constructing a combined antenna device, comprising:

forming a coupled feed antenna comprising a primary radiator element and at least a first grounded coupling element; and forming a millimeter wave phased array antenna having a ground plane structure that comprises a portion of the first grounded coupling element and a plurality of antenna elements on a substrate overlying the ground plane structure.

15. The method of claim 14, wherein forming the coupled feed antenna further comprises:

forming a ground element; and forming a first ground trace extending between the ground element and the first grounded coupling element, wherein the first ground trace comprises a geometry that defines a first inductance, wherein the first grounded coupling element is spatially positioned with respect to the primary radiator element to define a first capacitive coupling therewith, and wherein the first inductance and the first capacitive coupling define a first parasitic resonance that extends a low band bandwidth of the coupled feed antenna.

16. The method of claim 15, wherein the ground plane structure comprises a port configured to receive a connector for coupling the ground plane structure to a ground potential, the method further comprising forming a conductor connected to the port and extending along and electrically contacting an entirety of the first ground trace between the ground element and the ground plane structure.

* * * * *